US009350121B2

(12) United States Patent
Ju et al.

(10) Patent No.: US 9,350,121 B2
(45) Date of Patent: May 24, 2016

(54) ELECTRICAL CONNECTOR WITH IMPROVED GROUNDING MEANS

(71) Applicant: LOTES CO., LTD, Keelung (TW)

(72) Inventors: Ted Ju, Keelung (TW); Wen Wei Lin, Keelung (TW); Li Ming Zhang, Keelung (TW); Chin Chi Lin, Keelung (TW)

(73) Assignee: LOTES CO., LTD., Keelung (TW)

( * ) Notice: Subject to any disclaimer, the term of this patent is extended or adjusted under 35 U.S.C. 154(b) by 0 days.

(21) Appl. No.: 14/604,168

(22) Filed: Jan. 23, 2015

(65) Prior Publication Data

US 2015/0244110 A1 Aug. 27, 2015

Related U.S. Application Data

(60) Provisional application No. 62/024,728, filed on Jul. 15, 2014, provisional application No. 61/942,830, filed on Feb. 21, 2014.

(51) Int. Cl.

| | |
|---|---|
| ***H01R 9/03*** | (2006.01) |
| ***H01R 13/6585*** | (2011.01) |
| ***H01R 13/6581*** | (2011.01) |
| ***H01R 13/6591*** | (2011.01) |
| ***H01R 13/6583*** | (2011.01) |
| *H01R 24/60* | (2011.01) |
| *H01R 107/00* | (2006.01) |
| *H01R 12/72* | (2011.01) |
| *H01R 13/6594* | (2011.01) |

(52) U.S. Cl.

CPC ..... *H01R 13/6585* (2013.01); *H01R 13/6581* (2013.01); *H01R 13/6583* (2013.01); *H01R 13/6591* (2013.01); *H01R 12/724* (2013.01); *H01R 13/6594* (2013.01); *H01R 24/60* (2013.01); *H01R 2107/00* (2013.01)

(58) Field of Classification Search

CPC ..... H01R 13/6585; H01R 13/6581; H01R 13/6591; H01R 24/60; H01R 2107/00

USPC ..... 439/607.01, 607.02, 607.08, 607.06, 439/607.07, 607.28

See application file for complete search history.

(56) References Cited

U.S. PATENT DOCUMENTS

| | | | | |
|---|---|---|---|---|
| 6,257,914 | B1 * | 7/2001 | Comerci | H01R 13/6273 439/357 |
| 6,290,530 | B1 * | 9/2001 | Chang | H01R 13/631 439/357 |
| 6,364,687 | B1 * | 4/2002 | Chen | H01R 13/6275 439/358 |

(Continued)

*Primary Examiner* — Tulsidas C Patel
*Assistant Examiner* — Peter G Leigh
(74) *Attorney, Agent, or Firm* — Locke Lord LLP; Tim Tingkang Xia, Esq.

(57) ABSTRACT

An electrical connector for mating with a mating connector includes an insulating body having a base and a tongue extending forward from the base. An upper row of terminals and a lower row of terminals are disposed in the insulating body. Each upper or lower row terminal has a contact portion exposed from an upper or a lower surface of the tongue, respectively. An upper and a lower grounding sheets are laminated to the upper and lower surfaces of the tongue respectively, and are assembled and connected to each other. A shielding case covers the periphery of the insulating body, and the upper and lower grounding sheets. The shielding case, the insulating body, and the upper and lower grounding sheets together form an insertion space for the mating connector to be inserted therein. The shielding case is respectively and electrically conducted to the upper and lower grounding sheets.

10 Claims, 5 Drawing Sheets

(56) References Cited

U.S. PATENT DOCUMENTS 6,607,397 B1 * 8/2003 Zhang ..... H01R 13/193 439/357
6,966,797 B2 * 11/2005 Ko ..... H01R 13/65802 439/607.42
6,976,876 B1 * 12/2005 Su ..... H01R 13/6583 439/357
7,530,845 B1 * 5/2009 Yang ..... G02B 6/4201 439/607.01
7,682,184 B2 * 3/2010 Ko ..... H01R 12/594 439/495
8,011,956 B1 * 9/2011 Yang ..... H01R 13/5202 439/589
8,100,709 B2 * 1/2012 Zhang ..... H01R 13/6275 439/353
8,808,029 B2 * 8/2014 Castillo ..... H01R 13/6585 439/607.05
9,106,024 B2 * 8/2015 Zhao ..... H01R 13/6594
9,209,573 B1 * 12/2015 Chen ..... H01R 13/6581
9,281,642 B1 * 3/2016 Tseng ..... H01R 24/60
2010/0285683 A1 * 11/2010 Zhang ..... H01R 13/6275 439/357
2013/0130549 A1 * 5/2013 Wu ..... H01R 13/6598 439/607.01
2013/0231004 A1 * 9/2013 Yang ..... H01R 12/57 439/607.36
2013/0316581 A1 * 11/2013 Kao ..... H01R 13/6471 439/607.28
2013/0323970 A1 * 12/2013 Wang ..... H01R 13/6471 439/607.08
2013/0344739 A1 * 12/2013 Shih ..... H01R 13/658 439/607.28
2014/0099835 A1 * 4/2014 Chang ..... H01R 13/6581 439/682
2014/0113481 A1 * 4/2014 Little ..... H01R 13/64 439/374
2014/0194005 A1 * 7/2014 Little ..... H01R 13/6585 439/607.28
2014/0206233 A1 * 7/2014 Kao ..... H01R 13/6471 439/607.28
2014/0220827 A1 * 8/2014 Hsu ..... H01R 13/6594 439/629
2014/0349514 A1 * 11/2014 Yang ..... H01R 13/6581 439/487

* cited by examiner

ELECTRICAL CONNECTOR WITH IMPROVED GROUNDING MEANS

CROSS-REFERENCE TO RELATED APPLICATION

This application claims priority to and the benefit of, pursuant to 35 U.S.C. §119(e), U.S. provisional patent application Ser. No. 61/942,830, filed Feb. 21, 2014, entitled "ELECTRICAL CONNECTOR," by Chin Chi Lin, and U.S. provisional patent application Ser. No. 62/024,728, filed Jul. 15, 2014, entitled "ELECTRICAL CONNECTOR," by Ted Ju. The entire contents of the above identified applications are incorporated herein by reference.

Some references, if any, which may include patents, patent applications and various publications, may be cited and discussed in the description of this invention. The citation and/or discussion of such references, if any, is provided merely to clarify the description of the present invention and is not an admission that any such reference is "prior art" to the invention described herein. All references listed, cited and/or discussed in this specification are incorporated herein by reference in their entireties and to the same extent as if each reference was individually incorporated by reference.

FIELD OF THE INVENTION

The present invention relates to an electrical connector, and particularly to a thin-type electrical connector that can improve signal transmission quality.

BACKGROUND OF THE INVENTION

Currently, there is an electrical connector for improving signal transmission quality, such as that in Chinese patent application No. CN200420029031.1. The electrical connector includes a plastic body 10, and an upper terminal row 20*a* and a lower terminal row 20*b* disposed in the plastic body 10. A first grounding sheet embedding cavity 12*a* is disposed on the plastic body 10 and is located above the first terminal row 20*a* and adjacent to the first terminal row 20*a*. A second grounding sheet embedding cavity 12*b* is disposed on the plastic body 10 and is located above the second terminal row 20*b* and adjacent to the second terminal row 20*b*. A first grounding sheet 40*a* and a second grounding sheet 40*b* are respectively embedded into the upper and lower embedding cavities 12*a* and 12*b*, and separately conducted to a shielding casing 30 by using a joining tongue 42, so as to conduct electromagnetic waves generated by the first and second terminal rows 20*a* and 20*b* to a grounding circuit, thereby avoiding interference from the electromagnetic waves of the first and second terminal rows 20*a* and 20*b*.

This structure requires sufficient thickness of the plastic body, such that the grounding sheets can be embedded into the embedding cavities of the plastic body. However, this is contrary to the ultrathin-type development trend of the electrical connector, and this electrical connector cannot take account of both thinness and signal transmission quality.

Therefore, a heretofore unaddressed need exists in the art to address the aforementioned deficiencies and inadequacies.

SUMMARY OF THE INVENTION

In one aspect, the present invention is directed to an electrical connector that takes account of both thinness and signal transmission quality.

In one embodiment, an electrical connector for mating with a mating connector includes an insulating body, an upper row of terminals and a lower row of terminals disposed in the insulating body, an upper grounding sheet and a lower grounding sheet, and a shielding case. The insulating body includes a base and a tongue extending forward from the base. Each of the upper row of terminals has a contact portion exposed from an upper surface of the tongue, and each of the lower row of terminals has a contact portion exposed from a lower surface of the tongue. The upper grounding sheet and the lower grounding sheet are laminated to the upper surface and the lower surface of the tongue respectively. The upper grounding sheet and the lower grounding sheet are assembled and connected to each other. The shielding casing covers the periphery of the insulating body, the upper grounding sheet and the lower grounding sheet. The shielding case, the insulating body, the upper grounding sheet and the lower grounding sheet together form an insertion space for the mating connector to be inserted therein. The shielding case is separately and electrically conducted to the upper grounding sheet and the lower grounding sheet.

In one embodiment, the upper grounding sheet and the lower grounding sheet are in a snap-fit connection to each other. The upper grounding sheet includes a flat portion covering a rear segment of the upper surface of the tongue, and an elastic arm extending backward from the flat portion. The elastic arm is located above the base and urges against the shielding case upward elastically. Multiple depressed portions are depressed downward from the flat portion and used for snap-fitting a grounding elastic sheet in the mating connector. A snap-fit portion covering a side edge of the tongue bends downward from each of two ends of the flat portion, and a protruding block protrudes from the snap-fit portion outward. The lower grounding sheet includes a plate shaped portion covering a rear segment of a lower side of the tongue, and an urging portion extending backward from the plate shaped portion. The urging portion is located below the base and urges against the shielding case. Multiple depressed portions are depressed upward from the plate shaped portion and used for snap-fitting a grounding elastic sheet in the mating connector. A buckling portion covering a side edge of the tongue bends upward from each of two ends of the plate shaped portion, and the buckling portion is provided with a through-hole.

In one embodiment, the insulating body includes an upper body and a lower body, and the upper body and the lower body together form the tongue. The upper row of terminals is fixed to an insulating block. The insulating block and the upper row of terminals are together insert-molded into the upper body. The lower row of terminals is fixed to the lower body. The lower body and the lower row of terminals are together assembled on a lower surface of the upper body. The upper grounding sheet is laminated to an upper surface of the upper body, and the lower grounding sheet is laminated to a lower surface of the lower body.

In one embodiment, the shielding case and the lower grounding sheet are connected by means of spot welding.

Compared with the related art, in certain embodiments of the present invention, the upper grounding sheet and the lower grounding sheet are respectively laminated to the upper surface and the lower surface of the tongue, the upper grounding sheet and the lower grounding sheet are assembled and connected to each other, and it is not required to be like that in the related art to dispose embedding cavities on the insulating body to fix the upper grounding sheet and the lower grounding sheet. This may effectively reduce the thickness of the insulating body and even the thickness of the entire electrical connector. Since the upper grounding sheet and the lower grounding sheet are electrically conducted to the shielding case, and the upper grounding sheet and the lower grounding sheet are connected to each other, when one of the upper grounding sheet and the lower grounding sheet is connected to the shielding case unstably, electromagnetic interference can still be conducted to the shielding case by using the other of the upper grounding sheet and the lower grounding sheet and further conducted to a grounding line, so as to effectively ensure shielding functions of the upper grounding sheet and the lower grounding sheet, and ensure quality of signal transmission in the electrical connector.

These and other aspects of the present invention will become apparent from the following description of the preferred embodiment taken in conjunction with the following drawings, although variations and modifications therein may be effected without departing from the spirit and scope of the novel concepts of the disclosure.

DETAILED DESCRIPTION OF THE INVENTION

Figure 1:
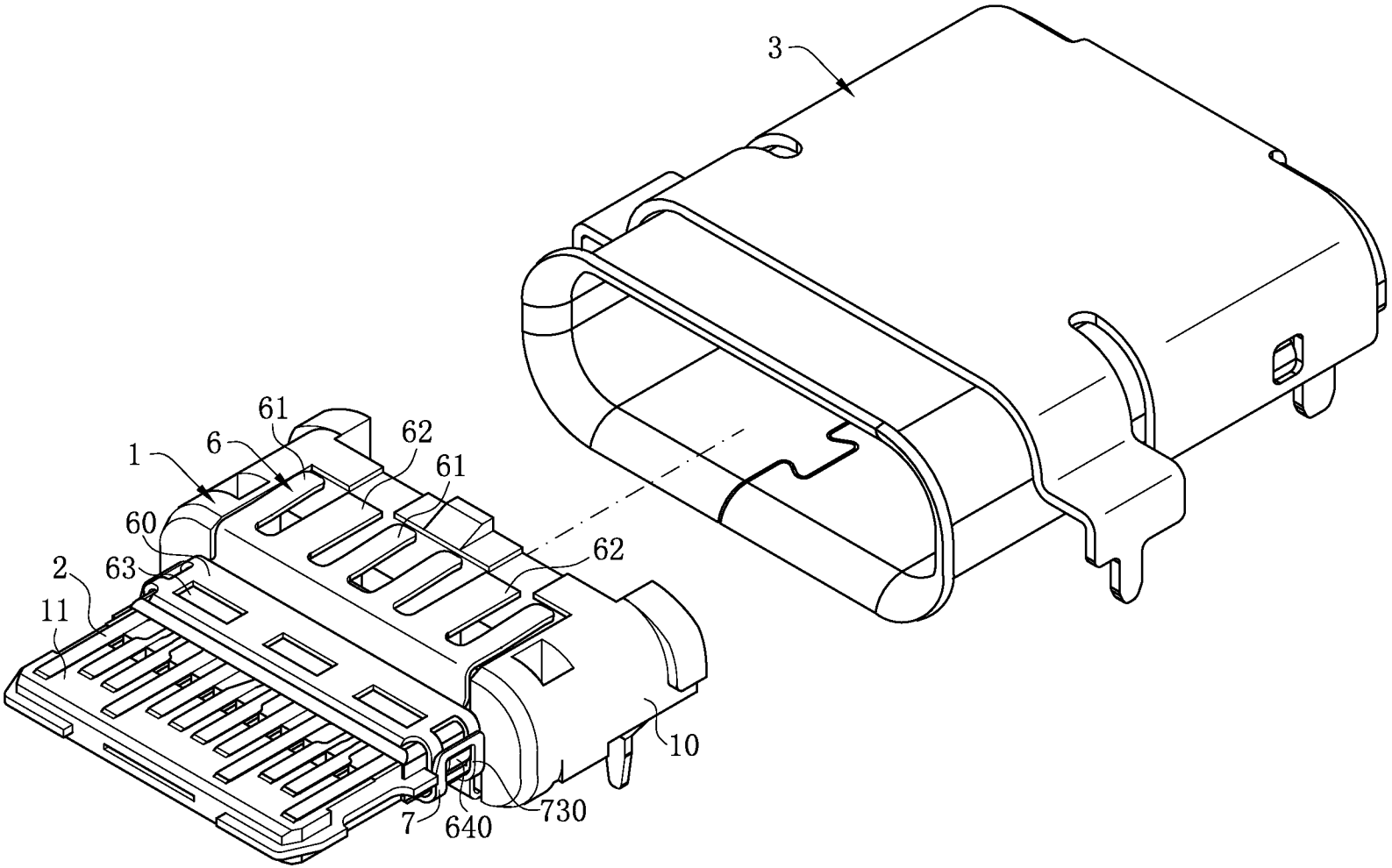
FIG. 1 is a schematic diagram of an electrical connector having a shielding case separated according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

Figure 2:
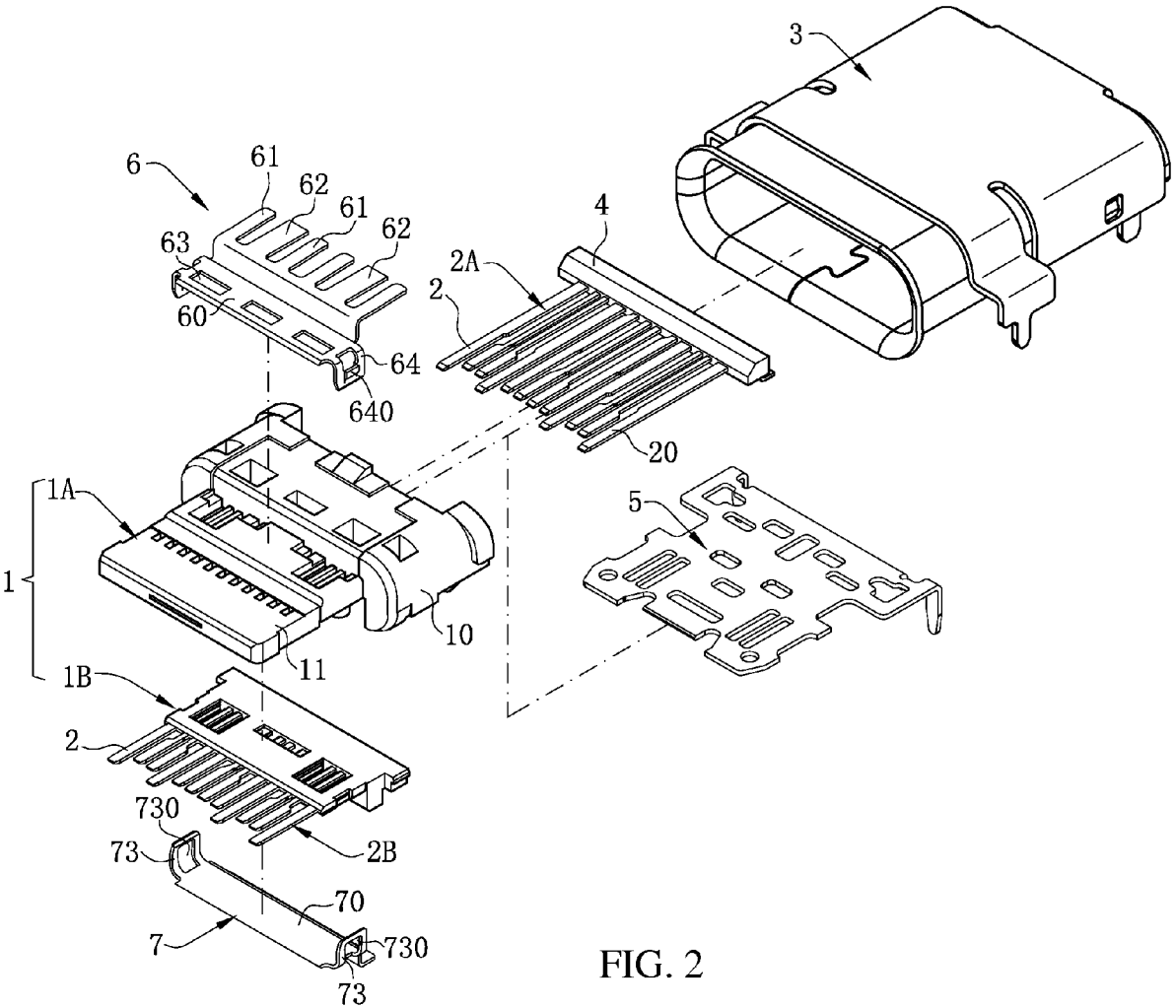
FIG. 2 is a schematic diagram of further explosion of FIG. 1.
Figure 3:
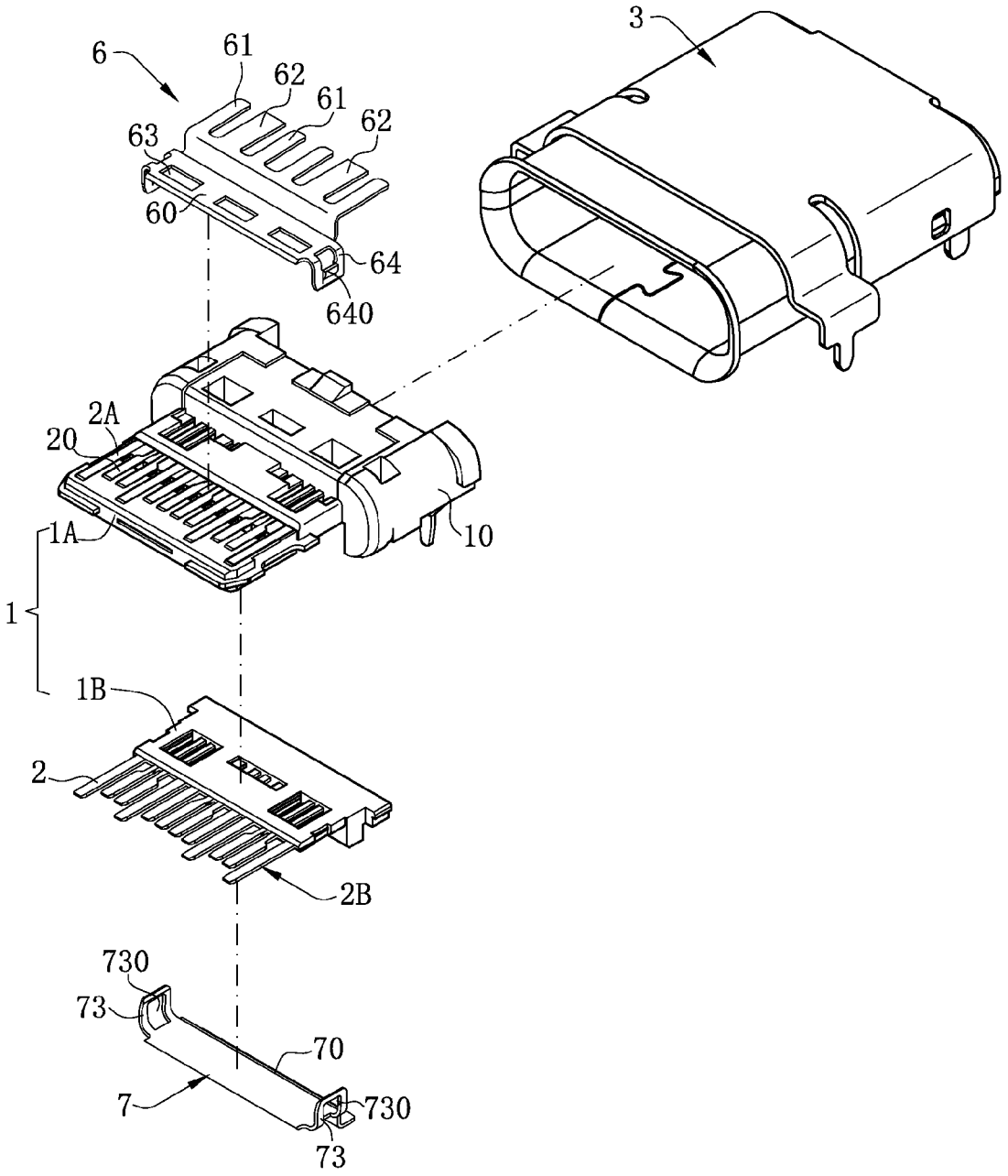
FIG. 3 is a schematic diagram of molding an upper row of terminals and an upper body together in FIG. 2.
Figure 4:
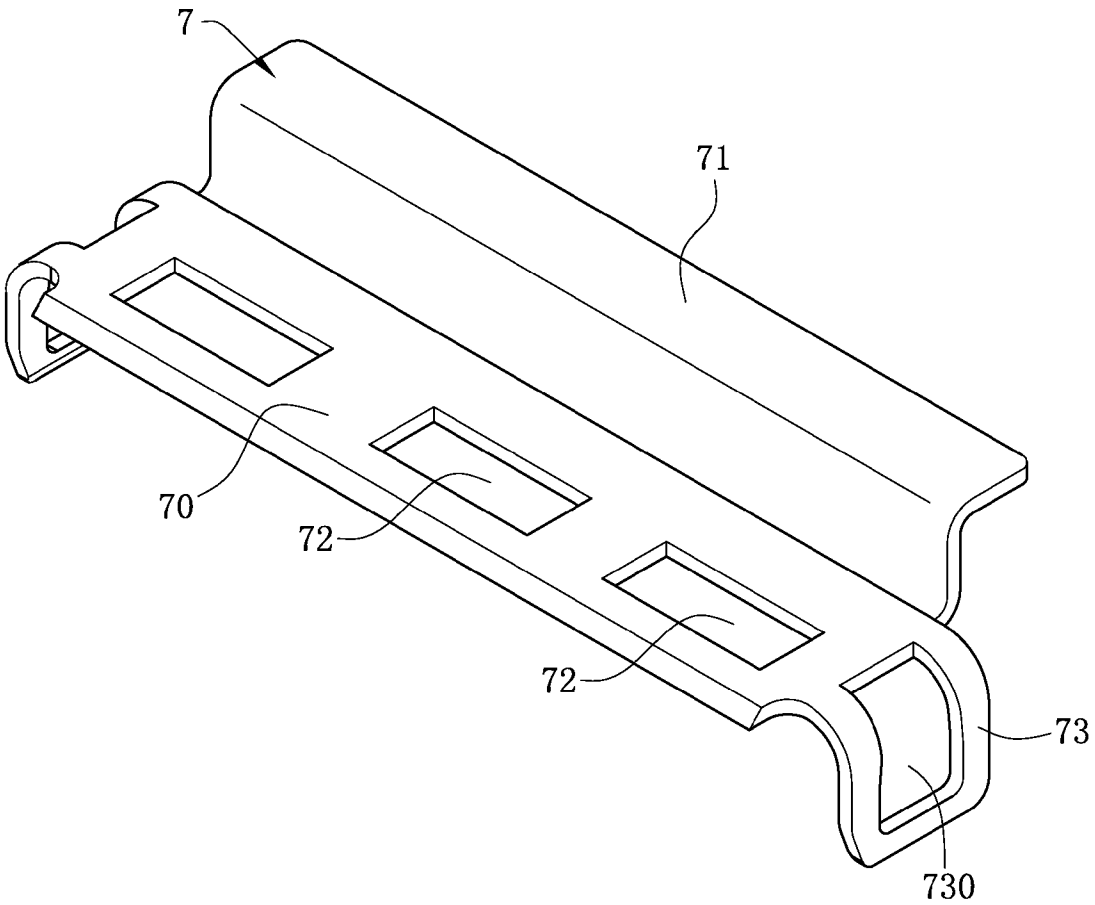
FIG. 4 is a three-dimensional view of a lower grounding sheet according to one embodiment of the present invention.
Figure 5:
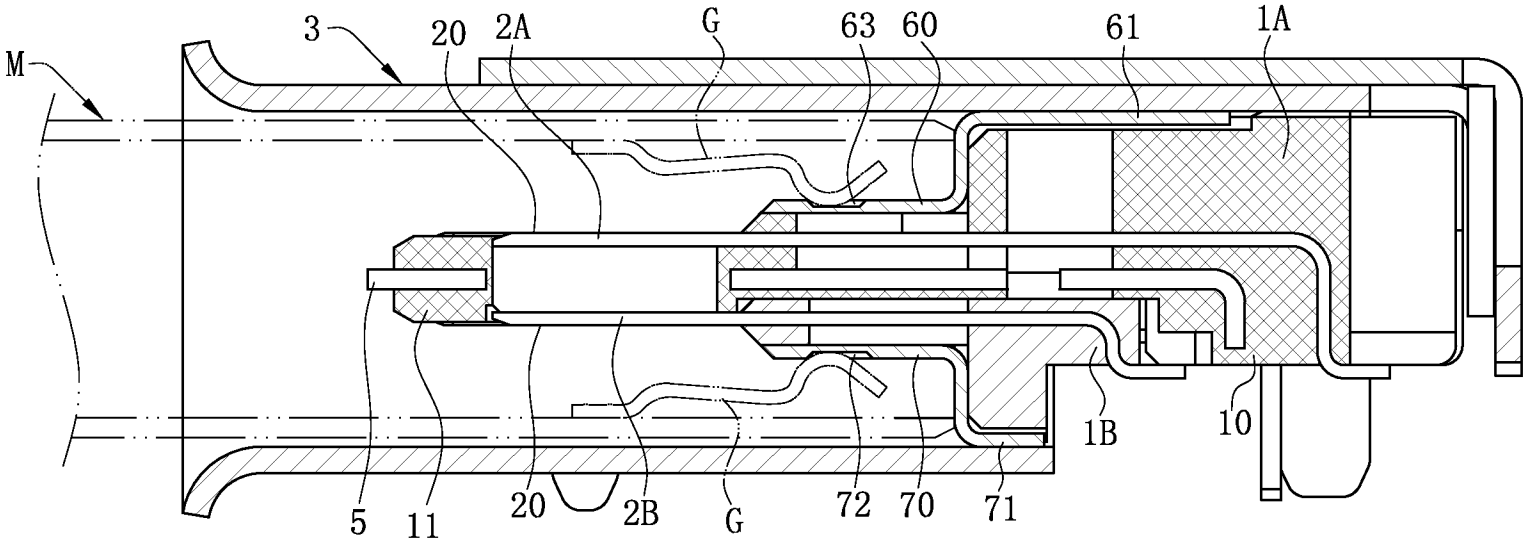
FIG. 5 is a sectional view of mating the electrical connector and a mating connector according to one embodiment of the present invention.

The description will be made as to the embodiments of the present invention in conjunction with the accompanying drawings in FIGS. 1-5. In accordance with the purposes of this invention, as embodied and broadly described herein, this invention, in one aspect, relates to an electrical connector.

FIGS. 1-5 show an electrical connector according to one embodiment of the present invention, used for mating with a mating connector M. The electrical connector includes an insulating body 1, terminals 2 fixed in the insulating body 1, and a shielding case 3 covering the insulating body 1. The shielding case 3 surrounds the insulating body 1 to form an insertion space for the mating connector M to be inserted therein.

The electrical connector according to certain embodiments of the present invention is of a sinking type, and has a small thickness. The insulating body 1 includes a base 10, and a tongue 11 extending forward from the base 10. The thickness of the tongue 11 is small, and the thickness of the base 10 is greater than the thickness of the tongue 11, so as to hold the terminals 2. The tongue 11 includes a front segment and a rear segment. The thickness of the rear segment is slightly greater than the thickness of the front segment. In this embodiment, the insulating body 1 is of a two-piece type, and includes an upper body 1A and a lower body 1B. The upper body 1A and the lower body 1B snap-fit to each other along an up-down direction. The lower body 1B and the upper body 1A together only form a part of the base 10 and the rear segment of the tongue 11. That is, the front segment of the tongue 11 is only formed by the upper body 1A.

An upper row of terminals 2A and a lower row of terminals 2B are disposed in the insulating body 1. Specifically, the upper row of terminals 2A is fixed to an insulating block 4 in an insert molding manner. The insulating block 4 and the upper row of terminals 2A are together insert-molded into the upper body 1A. The lower row of terminals 2B is fixed to the lower body 1B in an insert molding manner. The lower body 1B and the lower row of terminals 2B are together assembled on a lower surface of the upper body 1A. Each terminal 2 of the upper row of terminals 2A has a contact portion 20 exposed from an upper surface of the tongue 11, and each terminal 2 of the lower row of terminals 2B has a contact portion 20 exposed from a lower surface of the tongue 11.

The upper and lower rows of terminals 2A and 2B are vertically symmetrically disposed on the tongue 11, and are arranged in the same manner, and therefore may be inserted in dual orientation. Specifically, each row of terminals 2A or 2B is sequentially from left to right as follows: a grounding terminal, a pair of USB 3.0 terminals, a power supply terminal, a reserved terminal, a pair of USB 2.0 terminals, a reserved terminal, a power supply terminal, a pair of USB 3.0 terminals, and a grounding terminal.

In one embodiment, the electrical connector further includes a middle grounding sheet 5 inserted in the upper body 1A and located between the upper and lower rows of terminals 2A and 2B. At least one grounding pin extends from the middle grounding sheet 5 toward a circuit board, such that electromagnetic wave interference between the two rows of terminals 2A and 2B is conducted to a grounding circuit.

In one embodiment, the electrical connector further includes an upper grounding sheet 6 and a lower grounding sheet 7 respectively laminated to the upper surface and the lower surface of the tongue 11. The upper grounding sheet 6 and the lower grounding sheet 7 are assembled and connected to each other. Specifically, the upper grounding sheet 6 is laminated to the upper surface of the upper body 1A. The upper grounding sheet 6 includes a flat portion 60 covering the rear segment of the upper surface of the tongue 11. Four elastic arms 61 extend backward from the flat portion 60. The elastic arms 61 are located above the base 10 and urge against the shielding case 3 upward elastically. Moreover, two material connection portions 62 further extend backward from the flat portion 60, so as to provide convenience for assembly of the upper grounding sheet 6. Multiple depressed portions 63 are depressed downward from the flat portion 60 and are used for snap-fitting a grounding elastic sheet G in the mating connector M. A snap-fit portion 64 bends downward from each of two ends of the flat portion 60 covers a side edge of the tongue 11. A protruding block 640 protrudes from the snap-fit portion 64 outward. The lower grounding sheet 7 is laminated to the lower surface of the lower body 1B. The lower grounding sheet 7 includes a plate shaped portion 70 covering the rear segment of the lower side of the tongue 11, and an urging portion 71 extending backward from the plate shaped portion 70. The urging portion 71 is located below the base 10 and urges against the shielding case 3. Likewise, multiple depressed portions 72 are depressed upward from the plate shaped portion 70 and are used for snap-fitting a grounding elastic sheet G in the mating connector M. A buckling portion 73 bends upward from each of two ends of the plate shaped portion 70 and covers a side edge of the tongue 11, and the buckling portion 73 is provided with a through-hole 730 correspondingly snap-fitting the protruding block 640 on the upper grounding sheet 6. In one embodiment, to further ensure contact between the lower grounding sheet 7 and the shielding case 3, the shielding case 3 and the lower grounding sheet 7 are connected in a spot welding manner.

The electrical connector according to certain embodiment of the present invention, among other things, has the following beneficial advantages.

1. The upper grounding sheet 6 and the lower grounding sheet 7 are respectively laminated to the upper surface and the lower surface of the tongue 11, the upper grounding sheet 6 and the lower grounding sheet 7 are assembled and connected to each other, and it is not required to be like that in the related art to dispose embedding cavities on the insulating body 1 to fix the upper grounding sheet 6 and the lower grounding sheet 7, which may effectively reduce the thickness of the insulating body 1 and even the thickness of the entire electrical connector. The upper grounding sheet 6 and the lower grounding sheet 7 are electrically conducted to the shielding case 3, and the upper grounding sheet 6 and the lower grounding sheet 7 are connected to each other. When one of the upper grounding sheet 6 and the lower grounding sheet 7 is connected to the shielding case 3 unstably, electromagnetic interference can still be conducted to the shielding case 3 by using the other of the upper grounding sheet 6 and the lower grounding sheet 7 and further conducted to a grounding line, so as to effectively ensure shielding functions of the upper grounding sheet 6 and the lower grounding sheet 7, and ensure quality of signal transmission in the electrical connector.

2. For the insulating body 1 of the two-piece type, the upper grounding sheet 6 is laminated to the upper surface of the upper body 1A, the lower grounding sheet 7 is laminated to the lower surface of the lower body 1B, and the upper grounding sheet 6 and the lower grounding sheet 7 are in a snap-fit connection to each other, such that the upper body 1A and the lower body 1B can be firmly fixed together, and are not easy to separate.

3. The upper grounding sheet 6 and the lower grounding sheet 7 are respectively provided with the depressed portion 63 and the depressed portion 72. When the mating connector M is inserted, the grounding elastic sheets G in the mating connector M may be separately snap-fitted in the depressed portions 63 and 72. The grounding elastic sheets G not only connect the electrical connector and the grounding line of the mating connector M integrally so as to implement shielding functions thereof, but also can prevent the mating connector M from withdrawing from the insertion space of the electrical connector.

4. The upper grounding sheet 6 and the lower grounding sheet 7 are snap-fitted by using a structure of cooperation between the protruding block 640 and the through-hole 730, and are in a stable snap-fit connection.

5. While the lower grounding sheet 7 urges against the shielding case 3, the shielding case 3 and the lower grounding sheet 7 are connected in a spot welding manner, which can further ensure contact between the lower grounding sheet 7 and the shielding case 3, and ensure that the lower grounding sheet 7 can conduct electromagnetic wave interference to the shielding case 3.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector for mating with a mating connector, comprising:

an insulating body, having a base and a tongue extending forward from the base;

an upper row of terminals and a lower row of terminals disposed in the insulating body, wherein each of the upper row of terminals has a contact portion exposed from an upper surface of the tongue, and each of the lower row of terminals has a contact portion exposed from a lower surface of the tongue;

an upper grounding sheet and a lower grounding sheet, laminated to the upper surface and the lower surface of the tongue respectively, wherein the upper grounding sheet and the lower grounding sheet are assembled and connected to each other; and a shielding case, covering the periphery of the insulating body, the upper grounding sheet and the lower grounding sheet, wherein the shielding case, the insulating body, the upper grounding sheet and the lower grounding sheet together form an insertion space for the mating connector to be inserted therein, and the shielding case is respectively and electrically conducted to the upper grounding sheet and the lower grounding sheet.

2. The electrical connector of claim 1, wherein the upper grounding sheet and the lower grounding sheet are in a snap-fit connection to each other.

3. The electrical connector of claim 1, wherein the upper grounding sheet comprises a flat portion covering a rear segment of the upper surface of the tongue, and an elastic arm extending backward from the flat portion, and the elastic arm is located above the base and urges against the shielding case upward elastically.

4. The electrical connector of claim 3, wherein a plurality of depressed portions are depressed downward from the flat portion and used for snap-fitting a grounding elastic sheet in the mating connector.

5. The electrical connector of claim 3, wherein a snap-fit portion bends downward from each of two ends of the flat portion and covers a side edge of the tongue, and a protruding block protrudes from the snap-fit portion outward.

6. The electrical connector of claim 1, wherein the lower grounding sheet comprises a plate shaped portion covering a rear segment of a lower side of the tongue, and an urging portion extending backward from the plate shaped portion, and the urging portion is located below the base and urges against the shielding case.

7. The electrical connector of claim 6, wherein a plurality of depressed portions are depressed upward from the plate shaped portion and used for snap-fitting a grounding elastic sheet in the mating connector.

8. The electrical connector of claim 6, wherein a buckling portion bends upward from each of two ends of the plate shaped portion and covers a side edge of the tongue, and the buckling portion is provided with a through-hole.

9. The electrical connector of claim 1, wherein the insulating body comprises an upper body and a lower body, the upper body and the lower body together form the tongue, the upper row of terminals is fixed to an insulating block, the insulating block and the upper row of terminals are together insert-molded into the upper body, the lower row of terminals is fixed to the lower body, the lower body and the lower row of terminals are together assembled on a lower surface of the upper body, the upper grounding sheet is laminated to an upper surface of the upper body, and the lower grounding sheet is laminated to a lower surface of the lower body.

10. The electrical connector of claim 1, wherein the shielding case and the lower grounding sheet are connected by spot welding.

* * * * *